US006697298B1

(12) United States Patent
Dubinsky et al.

(10) Patent No.: US 6,697,298 B1
(45) Date of Patent: Feb. 24, 2004

(54) HIGH EFFICIENCY ACOUSTIC TRANSMITTING SYSTEM AND METHOD

(75) Inventors: Vladimir Dubinsky, Houston, TX (US); David Schneider, Spring, TX (US); Terry Seyler, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 563 days.

(21) Appl. No.: 09/676,906

(22) Filed: Oct. 2, 2000

(51) Int. Cl.[7] ..... H04H 9/00

(52) U.S. Cl. ..... 367/81; 367/82; 340/854.4; 340/855.6; 73/152.01

(58) Field of Search ..... 367/81, 82; 340/854.4, 340/856.4, 855.6, 855.7; 73/152.01

(56) References Cited

U.S. PATENT DOCUMENTS 3,252,225 A * 5/1966 Hixson ..... 340/855.6
3,790,930 A * 2/1974 Lamel et al. ..... 340/854.4
3,813,656 A 5/1974 Fowler ..... 340/18 LD
4,314,365 A 2/1982 Petersen et al. ..... 367/82
4,850,449 A * 7/1989 Cheung ..... 181/101
4,992,997 A 2/1991 Bseisu ..... 367/82
5,319,610 A * 6/1994 Airhart ..... 367/82
5,568,448 A 10/1996 Tanigushi et al. ..... 367/82
5,675,325 A 10/1997 Taniguchi et al. ..... 340/854.4

FOREIGN PATENT DOCUMENTS

GB 2236782 A 4/1991

* cited by examiner

*Primary Examiner*—Timothy Edwards
(74) *Attorney, Agent, or Firm*—Madan, Mossman & Sriram, P.C.

(57) ABSTRACT

The present invention includes a well system having a sensor; a controller for converting the sensor output, a signal conducting mass, a magnetostrictive actuator for inducing an acoustic wave the signal conducting mass, a reaction mass being greater than the signal conducting mass, an acoustic wave receiver up-hole, and a processor for processing a signal from the acoustic wave receiver and for delivering the processed signal to an output device.

20 Claims, 6 Drawing Sheets

HIGH EFFICIENCY ACOUSTIC TRANSMITTING SYSTEM AND METHOD

BACKGROUND OF THE INVENTION

1. Field of the Invention

This invention relates generally to oil field tools, and more particularly to acoustic data telemetry devices for transmitting data from a downhole location to the surface.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a bottomhole assembly (BHA) and a drill bit at end thereof that is rotated by a drill motor (mud motor) and/or the drill string. A number of downhole devices in the BHA measure certain downhole operating parameters associated with the drill string and the wellbore. Such devices typically include sensors for measuring downhole temperature, pressure, tool azimuth, tool inclination, drill bit rotation, weight on bit, drilling fluid flow rate, etc. Additional downhole instruments, known as measurement-while-drilling ("MWD") and logging-while-drilling ("LWD") devices in the BHA provide measurements to determine the formation properties and formation fluid conditions during the drilling operations. The MWD or LWD devices usually include resistivity, acoustic and nuclear devices for providing information about the formation surrounding the borehole.

The trend in the oil and gas industry is to use a greater number of sensors and more complex devices, which generate large amounts of measurements and thus the corresponding data. Due to the copious amounts of downhole measurements, the data is typically processed. downhole to a great extent. Some of the processed data must be telemetered to the surface for the operator and/or a surface control unit or processor device to control the drilling operations, which may include altering drilling direction and/or drilling parameters such as weight on bit, drilling fluid pump rate, and drill bit rotational speed. Mud-pulse telemetry is most commonly used for transmitting downhole data to the surface during drilling of the borehole. However, such systems are capable of transmitting only a few (1–4) bits of information per second. Due to such a low transmission rate, the trend in the industry has been to attempt to process greater amounts of data downhole and transmit only selected computed results or "answers" uphole for controlling the drilling operations. Still, the data required to be transmitted far exceeds the current mud-pulse and other telemetry systems.

Although the quality and type of the information transmitted uphole has greatly improved since the use of microprocessors downhole, the current systems do not provide telemetry systems, which are accurate and dependable at low frequencies of around 100 Hz.

Acoustic telemetry systems have been proposed for higher data transmission rates. Piezoelectric materials such as ceramics began the trend. Ceramics, however require excessive power and are not very reliable in a harsh downhole environment. Magnetostrictive material is a more suitable material for downhole application. Magnetostrictive material is a material that changes shape (physical form) in the presence of a magnetic field and returns to its original shape when the magnetic field is removed. This property is known as magnetostriction.

Most ferromagnetic materials exhibit some measurable magnetostriction; however, considerable field magnitudes are required which make such materials impractical for downhole use. However, greater magnetostriction can be obtained by using certain specially formulated alloys. For example, iron alloys containing the rare earth elements Dysprosium, and Terbium placed under adequate mechanical bias can produce strains to about 2000 microstrain in a field of 2 KOE at room temperature. Certain specifically formulated alloys have been found to exhibit sufficient magnetostriction with reasonable power consumption for use in downhole telemetry applications. One such alloy is commercially available under the brand name Terfenol-D®.

Certain downhole telemetry devices utilizing a magnetostrictive material are described in U.S. Pat. Nos. 5,568,448 to Tanigushi et al. and 5,675,325 to Taniguchi et al. These patents disclose the use of a magnetostrictive actuator mounted at an intermediate position in a drill pipe, wherein the drill pipe acts as a resonance tube body. An excitation current applied at a predetermined frequency to coils surrounding the magnetostrictive material of the actuator causes the drill pipe to deform. The deformation creates an acoustic or ultrasonic wave that propagates through the drill pipe. The propagating wave signals are received by a receiver disposed uphole of the actuator and processed at the surface.

The above noted patents disclose that transmission efficiency of the generated acoustic waves is best at high frequencies (generally above 400 hz). The wave transmission, however drops to below acceptable levels at low frequencies (generally below 400 hz). The acoustic telemetry system according to the above noted patents requires precise placement of the actuator and unique "tuning" of the drill pipe section with the magnetostrictive device in order to achieve the most efficient transmission, even at high frequencies.

The precise placement requirements and low efficiency is due to the fact that such systems deform the drill pipe in order to induce the acoustic wave. In such systems, the magnetostrictive material works against the stiffness of the drill pipe in order to deform the pipe. Another drawback is that the deformation tends to be impeded by forces perpendicular ("normal" or "orthogonal") to the longitudinal drill pipe axis. In downhole applications, extreme forces perpendicular to the longitudinal drill pipe axis are created by the pressure of the drilling fluid ("mud") flowing through the inside of the drill pipe and by formation fluid pressure exerted on the outside of the drill pipe. Although the pressure differential across the drill pipe surface (wall) approaches zero with proper fluid pressure control, compressive force on the drill pipe wall remains. Deformation of the drill pipe in a direction perpendicular to the longitudinal axis is impeded, because the compressive force caused by the fluid pressure increases the stiffness of the drill pipe.

The present invention addresses one or more of the deficiencies of the above-noted acoustic telemetry systems, and provides a telemetry system wherein a magnetostrictive actuator deflects (moves) a tube body along a longitudinal direction thereof relative to a reaction mass. The reaction mass is separated from the tube body through which the transmission of the acoustic wave generated by the magnetostrictive actuator is desired. The mass of the reaction mass is substantially greater than the mass of the tube body, which allows the tube body to move relative to the reaction mass, thereby allowing transmission of the generated acoustic waves, even at a relatively low frequencies.

In one embodiment, the present invention includes, an elongated member (also referred to herein as the "signal conducting mass"), such as a drill pipe, that is a capable of conducting acoustic waves therethrough, a reaction mass and an acoustic actuator coupled to the elongated member and the reaction mass. The acoustic actuator generates axial force between the elongated member and the reaction mass at a predetermined frequency. The effective mass of the reaction mass is greater than the mass of the elongated member by an amount that is sufficient to cause a substantial portion of the axial force generated by the acoustic actuator to be applied to the elongated member. The axial force applied to the elongated member produces an acoustic wave at the predetermined frequency, which is transmitted through the elongated member.

In one embodiment of the present invention, the acoustic actuator is disposed in a drill string wherein the portion of the drill string uphole of the acoustic mass forms a movable elongated member and the portion of the drill string below or downhole of the acoustic actuator forms the reaction mass. During drilling of a wellbore, the drill string portion below the acoustic actuator is substantially immovable since the portion's axial movement is stopped by the wellbore bottom. Thus, the lower portion of the drill string acts as a reaction mass whose effective mass is many times greater than the drill string upper portion. Since the drill string upper portion is movable relative to the reaction mass, a substantial portion of the axial force generated by the acoustic actuator is transmitted into the drill string upper portion.

In an alternative embodiment of the present invention, the reaction mass may be a weight disposed within a drill string or it may be obtained by anchoring in the borehole a drill string section that is positioned below the acoustic actuator. The acoustic actuator includes a magnetostrictive element disposed between the signal conducting or transmitting mass and the reaction mass. A controller energizes coils disposed around the magnetostrictive element at a predetermined frequency, which causes the magnetostrictive material to simultaneously apply axial force to the signal conducting mass and the reaction mass. The effective mass of the reaction mass being significantly greater than the signal conducting mass causes a substantial portion of the axial force generated by the acoustic actuator to be applied to the signal conducting mass.

SUMMARY OF THE INVENTION

The present invention provides a magnetostrictive apparatus and a method for efficiently and effectively transmitting signals from a downhole location through a pipe such as a drill pipe or production pipe at low frequencies with high efficiencies. The apparatus and methods of the present invention may be utilized as a telemetry system in the drill string to transmit signals and data during drilling of wellbores or as a part of completion well and production well telemetry systems.

The present invention includes a signal conducting mass such as a metallic pipe, a reaction mass at least one actuator in a coupling arrangement with the signal conducting mass and the reaction mass for inducing an acoustic wave representative of a parameter of interest, wherein the mass of the reaction mass is greater than the signal conducting mass such that substantially all of the acoustic wave is transferred to the signal conducting mass. An acoustic wave receiver disposed in the signal conducting mass receives the acoustic wave and converts such acoustic wave to a signal indicative of the one parameter of interest. A processor processes the second signal from the acoustic wave receiver and determines the parameter of interest. The actuator includes a magnetostrictive member that exerts force on the signal conducting mass and the reaction mass at a predetermined frequency to induce the acoustic wave in the signal conducting mass. In one embodiment of the present invention, a section of the drill string below or downhole of the actuator is utilized as the reaction mass while the section of the drill string above or uphole of the actuator is utilized as the signal conducting mass. In an alternative embodiment, a portion of the pipe is firmly anchored in the wellbore and a section on one side of the anchor is utilized as the signal conducting mass while the earth is used as the reaction mass.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1A:
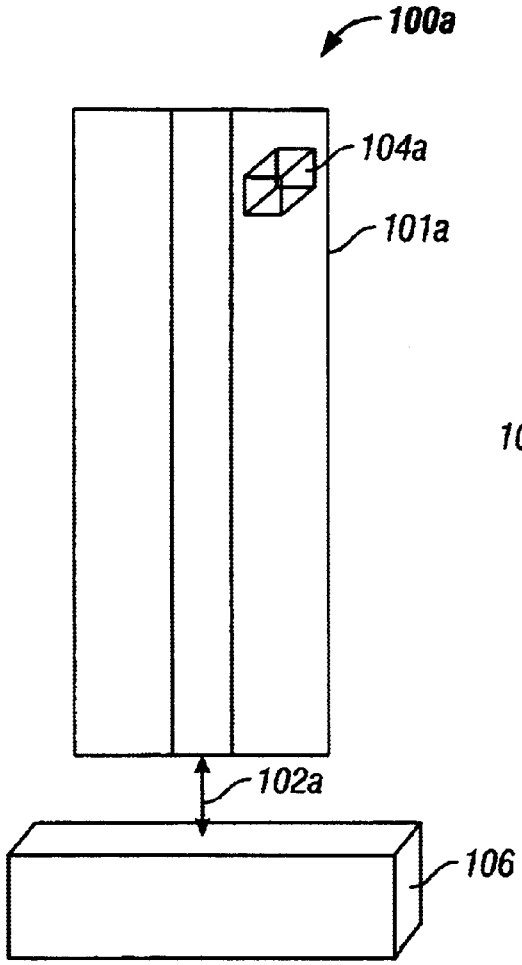
FIGS. 1A and 1B show schematic drawings of the conceptual difference between the present invention and certain prior art identified herein.
Figure 1B:
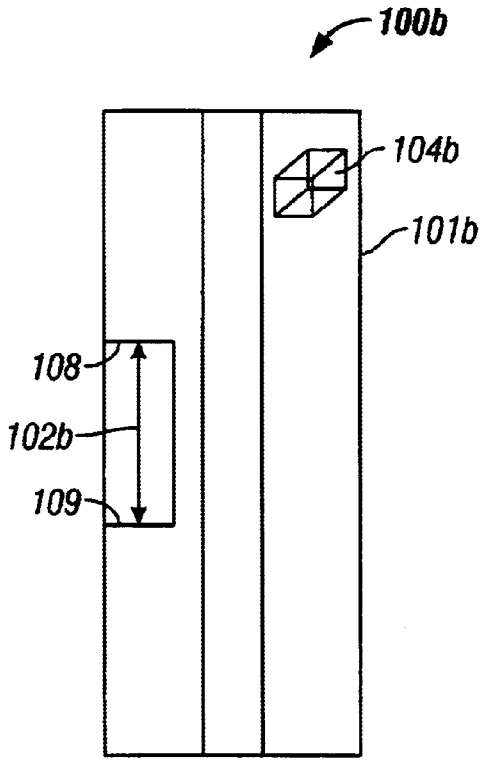

FIG. 1A is a schematic diagram of a system 100*a* illustrating the concept of the present invention while FIG. 1B shows the concept of a prior art telemetry systems 100*b* described above. In each case, an acoustic wave travels through a drill pipe or other tube-like mass 101*a* and 101*b* respectively, which acoustic wave is received by a corresponding receiver 104*a* and 104*b*. In the present invention, the acoustic wave is generated by a magnetostrictive actuator, which is described below in more detail with respect to specific embodiments. In the configuration of FIG. 1B, the acoustic wave is generated by applying a force 102*b* against surfaces 108 and 109 within a cavity formed in the wall of the drill pipe 101*b*. The force 102*b* works against the stiffness of the drill pipe 101*b*. The stiffness of the pipe acts as a damping force, which requires a large amount of power to induce a sufficient portion of the force 102*b* axially into the drill pipe 101*b* to generate the acoustic wave. Such a system is relatively inefficient. In addition, it has been found that a system such as system 100*b* is even less effective at frequencies below 400 Hz compared to frequencies above 1000 Hz. Furthermore, systems such as 100*b* require exact placement of and unique "tuning" of the drill pipe section containing the magnetostrictive actuator. The U.S. Pat. Nos. 5,568,448 and 5,675,325 noted above indicate that the optimum placement of the actuator in a drillpipe section is substantially midway between an upper and a lower end of the drill pipe section.

In the system 100*a* of the present invention a force 102*a* reacts with a reaction mass 106 and the drill pipe 101*a* in a manner that eliminates or substantially reduces the damping effects of the drill pipe stiffness. The mass of the reaction mass 106 is selected to be much greater than the mass of the drill pipe 101*a* so that the force 102*a* can "lift" or move the drill pipe 101*a* away from the reaction mass 106 with relatively negligible displacement of the reaction mass 106. The overall resultant force 102*a* is transferred to the drill pipe 101*a*. In this manner, a much greater portion of the force generated by the magnetostrictive actuator is transmitted to the drill pipe 101*a* in the system configuration of FIG. 1A compared to the configuration shown in FIG. 1B. The system of FIG. 1A requires substantially less power to induce an acoustic wave into the drill pipe compared to the system of FIG. 1B. The acoustic wave induced in the drill pipe 101*a* is detected by an acoustic receiver 104*a* located near the surface.

Figure 2:
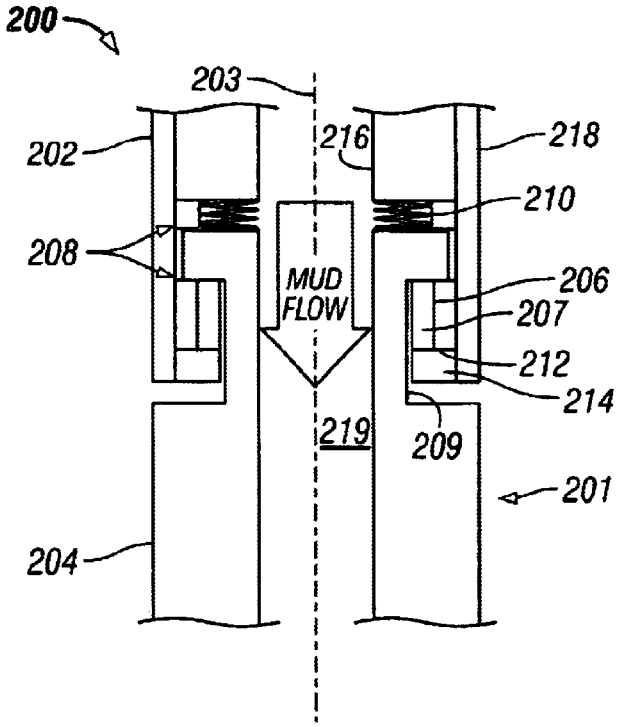
FIG. 2 is a cross section schematic of an acoustic telemetry system according to one embodiment of the present invention.

FIG. 2 is a cross section schematic diagram of an acoustic telemetry system 200 according to one embodiment of the present invention. This telemetry system 200 includes a reaction mass 204, which may be a lower section 201 of a drill string 200 and a substantially free section 202, which may be an upper section 202 of the drill string 200. The free section 202 is preferably a drill pipe. An acoustic actuator 206 including a force application member 207 made from a suitable magnetostrictive material, such as Terfenol-D®, a metal alloy composed of the elements terbium, dysprosium, and iron, is disposed around a portion 209 of the reaction mass 204. When current is applied to coils (not shown) surrounding the force application member 207, a magnetic field is created around the member 207. This magnetic field causes the magnetostrictive material 207 to expand along the longitudinal axis 203 of the drill pipe 202. Removing the current from the coils causes the magnetostrictive material 207 to contract to its original or near-original position. Repeated application and removal of the current to the coils at a selected frequency causes the actuator 206 to apply force on the section 202 at the selected frequency. This action induces an acoustic wave in the drill pipe 202. The acoustic wave is detected by a dector or receiver (described later) that is placed spaced apart from the actuator 206.

The drill string includes one or more downhole sensors (not shown) which provide to a controller signals representative of one or more for parameters of interest, which may include a borehole parameter, a parameter relating to the drill string and the formation surrounding the wellbore. The controller converts the sensor signal to a current pulse string, and delivers the current pulse string to the coils of actuator 206. With each current pulse, the actuator expands, thereby applying a force to the transmission mass 28. of the drill string 200 and to the reaction mass 204.

The upper section 202 is in a movable relationship with the lower section 201 such that the lower section 201 applies a compressive force to the magnetostrictive material 207. The actuator 206 is restrained at a lower end 212 by a restraining lip or portion 214 of the upper section 202. A compression spring 210 ensures that a selected amount of compression remains on the force application member 207 at all times. Stops or travel restrictors 208 provide control of the relative movement between the lower section 201 and the actuator 206.

In the embodiment of FIG. 2, the drill string 200 is assembled such that the effective mass of the lower section 201 is much greater than the mass of the upper section 202. When current is applied to the coils of the actuator 206, magnetostriction in the actuator creates an acoustic wave in the upper section 202. Since the effective mass of the lower section 201 is much greater than that of the upper section 202, most of the acoustic wave travels in the upper section 202. The pressure exerted on the inner wall 216 of the drill string 200 by drilling mud 219 flowing therethrough has little negative effect on the efficiency of the present invention, because the device of FIG. 2 does not rely on flexing the drill string section 204 or 202 in a direction perpendicular to the longitudinal axis 203 of the drill string 200.

Figure 3:
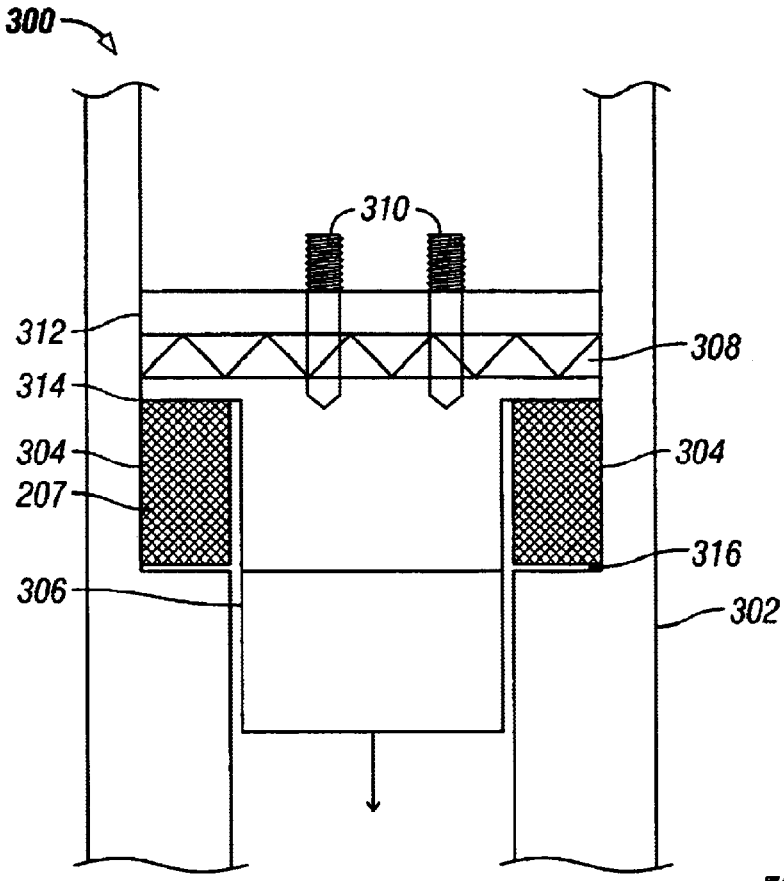
FIG. 3 is a cross section schematic showing an alternative reaction mass embodiment for an acoustic telemetry system according to the present invention.

FIG. 3 is a cross section schematic showing an alternative reaction mass embodiment for the acoustic telemetry system of the present invention. In this embodiment, a reaction mass 306 with its associated weight w is suspended within a drill string section 300 that includes a drill pipe 302. A substantial portion of the weight of the reaction mass 306 is born by a magnetostrictive actuator 304 at an upper end 314 of the actuator. The actuator 304 is restrained from downward axial movement downward by a restraining lip or portion 316 and upward axial movement being restrained by the reaction mass 306. A rotational restraining device such as pins 310 may be used to minimize energy losses from non-axial movement and to ensure that forces generated by the actuator 304 are directed into the drill pipe 302.

The actuator 304 includes a force application member 207 similar to the member shown in FIG. 2. For effective transfer of actuator energy to the drill pipe 302, the force application member 207 is maintained under a certain amount of compression at all times. To provide the compression, a spring 308 may be disposed above the reaction mass 306. A retention device 312 provides an upper restraint for the spring 308. The retention device 312 is attached to the drill pipe 302 in a fixed manner to inhibit or prevent movement of the retention device 312 relative to the drill pipe 302. With this arrangement, the drill pipe 302 is longitudinally displaced by forces generated by the magnetostrictive actuator 304.

The operation of the embodiment shown in FIG. 3 is similar to the operation of the embodiment shown in FIG. 2. The main distinction is that the reaction mass in FIG. 2 is the lower section 204 of the drill string 200, while the reaction mass 306 in FIG. 3 is not an integral part of the drill string section 300.

The embodiment of FIG. 3 uses one or more downhole sensors (not shown) associated with the drill string to provide signals representing one or more parameters to a controller (not shown). The controller converts the sensor signals to a current pulse string and delivers the string of pulses to the coils of actuator 304 at a selected frequency. With each current pulse, the actuator 304 as applies a force to the drill pipe 302 and to the reaction mass 306. The weight of the reaction mass 306 is selected to be sufficiently larger so that a the drill pipe 302 is moved axially away from the reaction mass 306 and returned to the original position at the selected frequency, thereby creating an acoustic wave in the drill pipe 302. The acoustic wave is then received by a receiver (not shown) that is positioned spaced apart from the actuator 304.

Figure 4A:
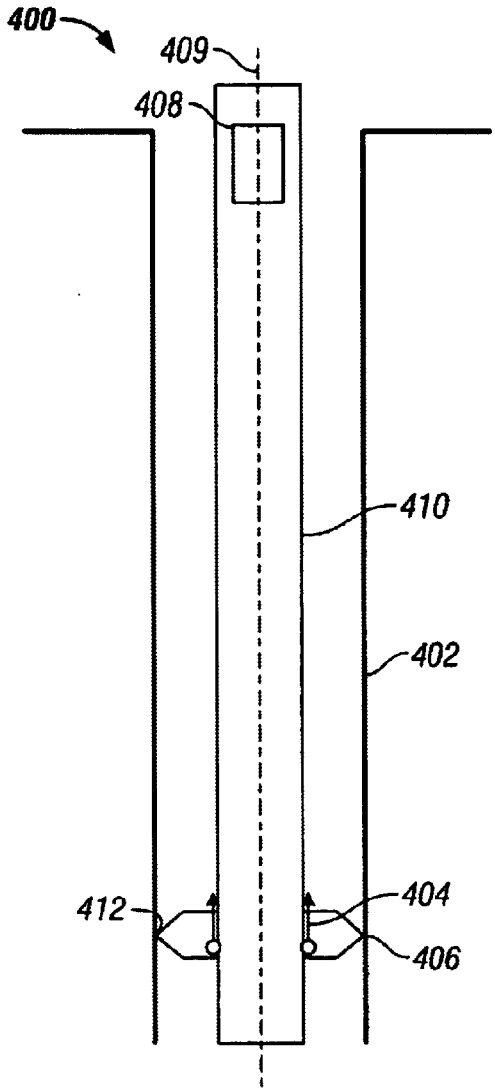
FIG. 4A is a schematic showing an embodiment of a portion of a telemetry system according to the present invention wherein the reaction mass is created by a "dead end".

FIG. 4A is a schematic showing an embodiment of a portion of a telemetry system 400 according to the present invention wherein the reaction mass is created by a "dead end" 406. This embodiment can be especially useful in completion and production well applications. In the embodiment of FIG. 4A, an anchor mechanism or device 406 which may be expandable pads or ribs, is disposed on the pipe 410. The device 406 can be selectively operated to engage the drill pipe or disengage the drill pipe from the borehole 402. Upon user or controller initiated commands, the device 406 extends until it firmly engages with the inner wall 412 of the borehole 402.

The anchor mechanism 406 can be disengaged from the borehole 402 upon command. The anchor mechanism may be a hydraulic, pneumatic, or an electro-mechanical device that can be operated or controlled from a surface location or which maybe a fully downhole controlled device. Still referring to FIG. 4A, a magnetostrictive actuator 404 such as one described above, is preferably mounted within the anchor mechanism 406. The pipe 410 and the anchor mechanism 406 are coupled in an axially moveable relationship with each other so that the drill pipe 410 can be axially displaced relative to the section 406 along the longitudinal pipe axis 409 when the actuator 404 is activated. The anchor mechanism 406 engages with the borehole 402 to exert sufficient pressure on the borehole wall 412 to ensure that anchor mechanism 406 is not displaced relative to the borehole wall 412 when the actuator 404 is activated. Not shown is a preloading spring as in the other embodiments, however a spring or another preloading device may be used to maintain the magnetostrictive element of the actuator 404 under compression.

The fixed relationship between the anchor mechanism 406 and the borehole 402 creates an acoustic wave "dead end" in the pipe 410 at the anchor mechanism 406. Anchoring of the pipe 410 causes the mass of the earth to act as the reaction mass. Thus, the dead end at the anchors 406 acts as the reaction mass point and causes the acoustic wave generated by the actuator 404 to travel in the drill pipe along the drill pipe section above the dead end.

Figure 4B:
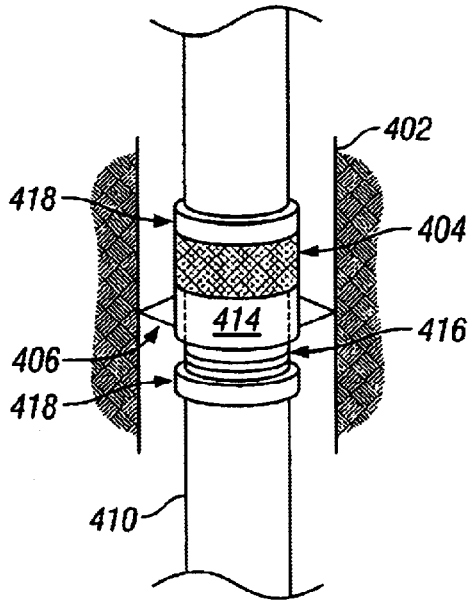
FIG. 4B is shows a magnetostrictive device mounted with force application members on a sleeve coupled to a drill pipe, which allows axial movement of the drill pipe relative to the sleeve.

FIG. 4B is an elevation view of one possible way to configure the embodiment described with respect to FIG. 4A to achieve a forceful interface with the borehole 402 while allowing axial displacement of the pipe 410. The pipe 410 includes keeper rings or offsets 418. Disposed around the pipe 410 and between the offsets 418 are the magnetostrictive material 404, a free-sliding sleeve or ring 414 and a biasing element or spring 416. Ribs 406 are mounted on the sleeve 414, so the ring becomes fixed when the ribs 406 apply force to the borehole wall 412. When the magnetostrictive material 404 is activated, substantially all of the force is transferred to the offsets 418, thus axially displacing the pipe 410. The biasing element 416 ensures a minimum predetermined compression load is maintained on the magnetostrictive material 404.

Figure 4C:
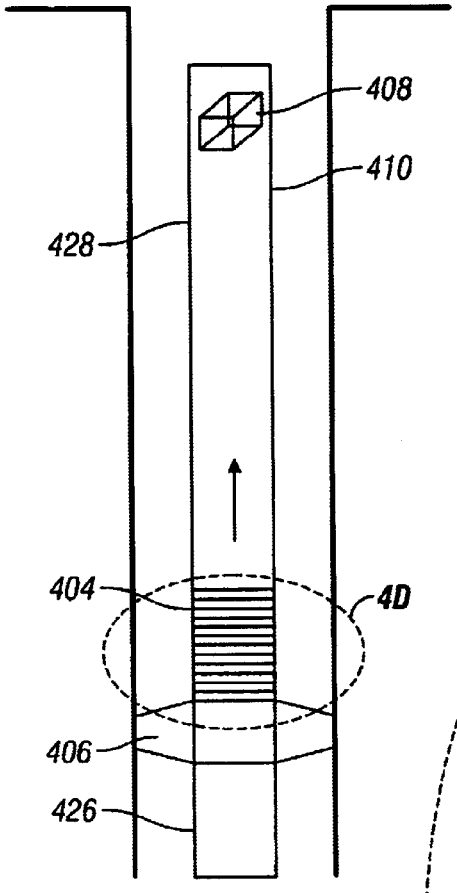
FIG. 4C is a schematic showing an embodiment of the present invention wherein the reaction mass is created by a "dead end" wherein an upper section of a pipe moves axially with respect to a force application members.
Figure 4D:
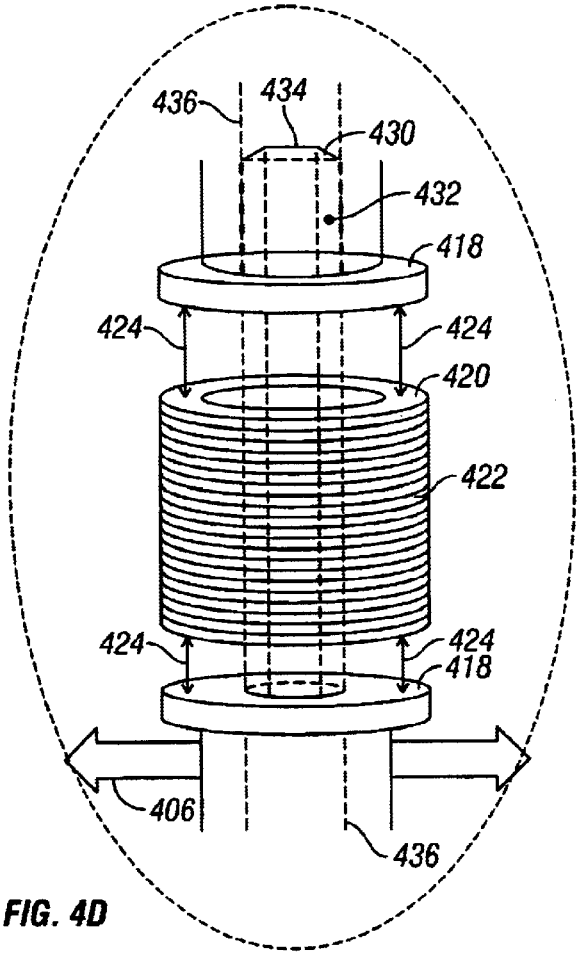
FIG. 4D is a detailed schematic of a magnetostrictive device mounted between a lower section of a pipe and an upper section of the pipe such that the upper section of the pipe moves axially with respect to force application members mounted on the lower section of the pipe.

Another dead end embodiment according to the present invention is shown in FIG. 4C. FIG. 4C shows ribs 406 applying force to the inner wall 412 of the borehole 402. The ribs 406 are mounted on a lower section of pipe 426 below the actuator 404. In this embodiment, the upper section of pipe 428 experiences substantially all of the axial displacement when the actuator 404 is excited. Shown in FIG. 4D is the actuator 404 with a cylindrical magnetostrictive core 420 and coils or windings 422. The coils 422 are wound around the cylindrical core 420.

The actuator 404 is attached to offsets 418 located on the upper section of pipe 428 and to the lower section of pipe 426 by any suitable manner, such as with fasteners 424. A biasing member, (not shown) maintains the actuator 404 in compression to a predetermined amount. The biasing member may be placed above or below the actuator 404.

The drill pipe 410 may include a section of reduced diameter 430 that is sized to be inserted in the inner bore 436 of the other pipe 428 for added stability between the upper section 428 and lower section 426. Of course the reduced diameter pipe 430 could also be carried by the upper pipe section 428 and be inserted into the inner bore 436 of the lower pipe 428. The reduced diameter pipe 430, which should be rigidly fixed (e.g. welded or milled as one piece) to the lower section 426, and have an internal through bore 434 to allow mud to flow for drilling operations. The reduced diameter pipe 430 should have a non-rigid connection such as a steel pin 432 to connect it to the upper sections 428 through a hole or slot in the upper section 428. This non-rigid connection would provide the necessary horizontal stability and rotational stability while maintaining enough freedom of movement in the vertical (axial) direction for transmitting the data pulses generated by the magnetostrictive element 404. As described above, either pipe may carry the reduced diameter pipe 430, and so either pipe may include the rigid or the non-rigid connection.

The configuration just described allows the upper section of pipe 428 to move axially with respect to the lower section of pipe 426. With the actuator 404 coupled above the ribs 406, an acoustic wave is transferred mostly through the upper section of pipe 428 to be received at the surface or intermediate location by a receiver 408. As with all other embodiments described herein, the stiffness of the pipe is decoupled from the actuator 404 movement thereby making transmission more efficient, even at low frequencies.

Figure 5:
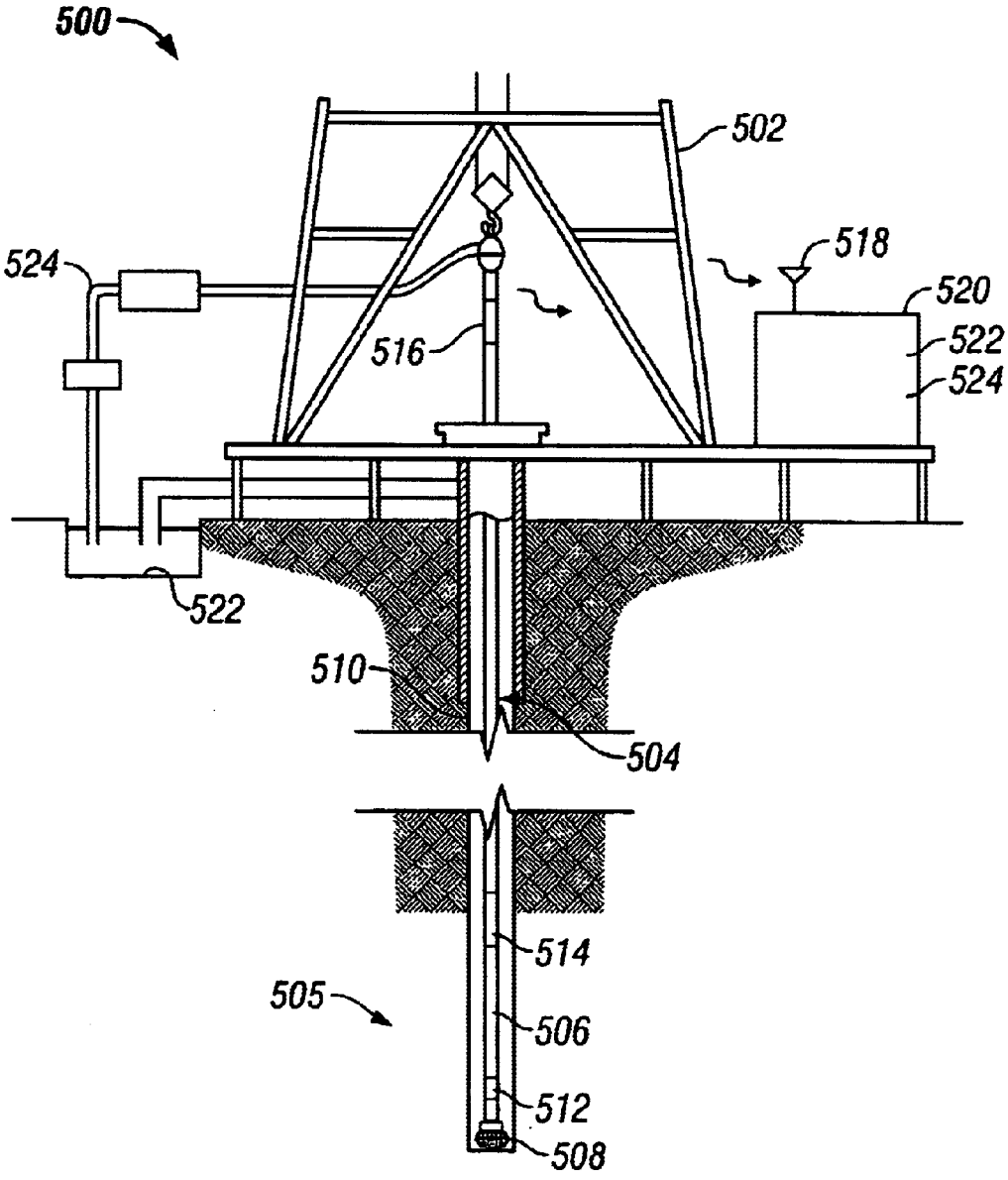
FIG. 5 is an elevation view of a drilling system in a MWD arrangement according to one embodiment of the present invention.

FIG. 5 is an elevation view of a drilling system 500 in a measurement-while-drilling (MWD) arrangement according to the present invention. As would be obvious to one skilled in the art, a completion well system would require reconfiguration; however the basic components would be the same as shown. A conventional derrick 502 supports a drill string 504, which can be a coiled tube or drill pipe. The drill string 504 carries a bottom hole assembly (BHA) 506 and a drill bit 508 at its distal end for drilling a borehole 510 through earth formations.

Drilling operations include pumping drilling fluid or "mud" from a mud pit 522, and using a circulation system 524, circulating the mud through an inner bore of the drill string 504. The mud exits the drill string 504 at the drill bit 508 and returns to the surface through the annular space between the drill string 504 and inner wall of the borehole 510. The drilling fluid is designed to provide the hydrostatic pressure that is greater than the formation pressure to avoid blowouts. The mud drives the drilling motor (when used) and it also provides lubrication to various elements of the drill string. Commonly used drilling fluids are either water-based or oil-based fluids. They also contain a variety of additives which provide desired viscosity, lubricating characteristics, heat, anti-corrosion and other performance characteristics.

A sensor 512 and a magnetostrictive acoustic actuator 514 are positioned on the BHA 506. The sensor 512 may be any sensor suited to obtain a parameter of interest of the formation, the formation fluid, the drilling fluid or any desired combination or of the drilling operations. Characteristics measured to obtain to desired parameter of interest may include pressure, flow rate, resistivity, dielectric, temperature, optical properties tool azimuth, tool inclination, drill bit rotation, weight on bit, etc. The output of the sensor 512 is sent to and received by a downhole control unit (not shown separately), which is typically housed within the BHA 506. Alternatively, the control unit may be disposed in any location along the drill string 504. The controller further comprises a power supply (not shown) that may be a battery or mud-driven generator, a processor for processing the signal received from the sensor 512, a converter for converting the signal to a sinusoidal or pulsed current indicative of the signal received, and a conducting path for transmitting the converted signal to coils of actuator 514. The actuator 514 may be any of the embodiments as described with respect to FIGS. 2–4, or any other configuration meeting the intent of the present invention.

The acoustic actuator 514 induces an acoustic wave representative of the signal in the drill pipe 504. A reaction mass 505 may be the lower portion of the drill string 504, may be a separate mass integrated in the drill string 504, or may be effectively created with a dead end by using a selectively extendible force application member (see FIGS. 2–4). The acoustic wave travels through the drill pipe 504, and is received by an acoustic wave receiver 516 disposed at a desired location on the drill string 504, but which is typically at the surface. A receiver 516 converts the acoustic wave to an output representative of the wave, thus representative of the parameter measured downhole. The converted output is then transmitted to a surface controller 520, either by wireless communication via an antenna 518 or by any conductor suitable for transmitting the output of the receiver 516. The surface controller 520 further comprises a processor 522 for processing the output using a program and an output device 524 such as a display unit for real-time monitoring by operating personnel, a printer, or a data storage device.

Figure 6:
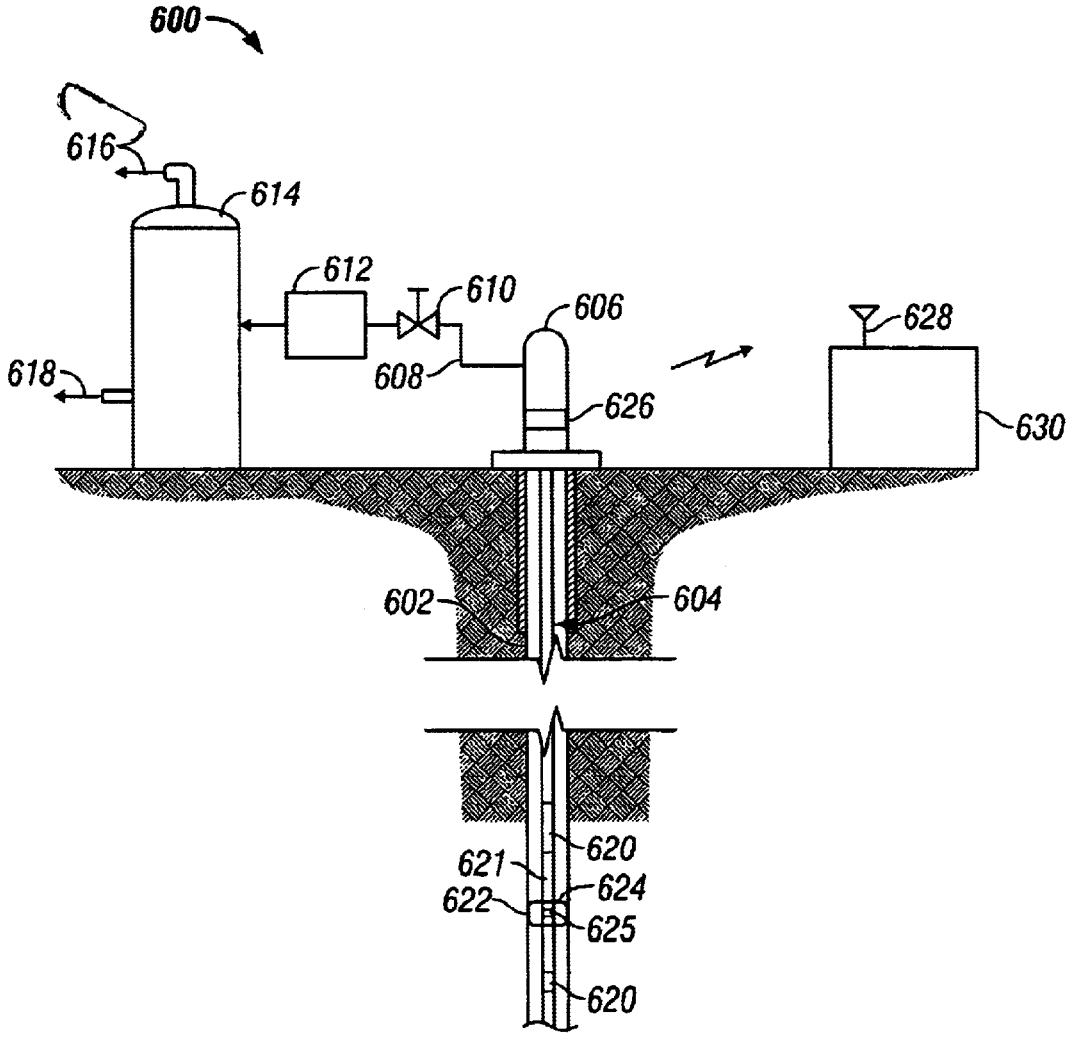
FIG. 6 is an elevation view of a production well system according to one embodiment of the present invention.

An embodiment of a production well telemetry system according to the present invention is shown in FIG. 6. The production well system 600 includes a production pipe 604 disposed in a well 602. At the surface a conventional wellhead 606 directs the fluids produced through a flow line 608. Control valve 610 and regulator 612 coupled to the flow line 608 are used to control fluid flow to a separator 614. The separator 614 separates the produced fluid into its component parts of gas 616 and oil 618. Thus far, the system described is well known in the art.

The embodiment shown for the production well system 600 includes a dead end configuration of an acoustic actuator 624. A suitable dead end configuration is described above and shown in FIG. 4. The acoustic actuator 624 includes at least one force application member 622 and a magnetostrictive material 625. Sensors 620 may be disposed above or below the force application member 622 to obtain desired characteristics and output a signal representing the characteristics. A downhole controller 621 includes a power supply, a processor for processing the output signal of the sensor 620, a converter for converting the signal to a sinusoidal or pulsed current indicative of the signal received, and a conducting path for transmitting the converted signal to the acoustic actuator 624. In a production configuration such as shown in FIG. 6, the controller 621 for the downhole operations may be located on the surface instead of downhole.

Magnetostrictive material 625 in the actuator 624 reacts to the current supplied by the controller by inducing an acoustic wave in the production pipe 604. The reaction mass is effectively created with a dead end by using a selectively extendible force application member 622 extended to engage the well wall. The acoustic wave travels through the production pipe 604, and is received by an acoustic wave receiver 626 disposed at any location on the production pipe 604, but which is typically at the surface in the wellhead 606. The receiver 626 converts the acoustic wave to an output indicative of the wave, thus indicative of the parameter measured downhole. The output is then transmitted to a surface controller 630 by wireless communication via an antenna 628 or by a conductor suitable for the output of the receiver 626. The surface controller 630 further comprises a processor for processing the signal using a program and an output device such as a display unit for real-time monitoring by operating personnel, a printer, or a data storage device.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An acoustic telemetry system for transmitting signals from within a well borehole to a surface location, comprising:

(a) an elongated member extending from within the borehole to the surface location, the elongated member being substantially free to move axially toward the surface and capable of carrying acoustic waves therethrough;

(b) a reaction mass in the borehole adjacent a lower end of the elongated member, the mass of the reaction mass being greater than the mass of the elongated member by an amount that causes a substantial portion of an axial force applied between the elongated member and the reaction mass to transmit into the elongated member; and (c) an acoustic actuator coupled to the elongated member and the reaction mass, the acoustic actuator exerting axial force on the elongated member and the reaction mass at a predetermined frequency, whereby the reaction mass causes the substantial portion of the axial force to transmit into the elongated member at the predetermined frequency.

2. The acoustic telemetry system of claim 1 wherein the elongated member and the reaction mass are coupled to each other in a manner that allows the elongated member to move axially relative to the reaction mass.

3. The acoustic telemetry system of claim 1 wherein the elongated member is selected from a group consisting of (i) a drill pipe; (ii) a coiled tubing; and (iii) a production tubing.

4. The acoustic telemetry system of claim 1 wherein the reaction mass is selected from a group consisting of (i) a lower section of a drill string disposed downhole of the actuator; (ii) a weight disposed within a drill string; and (iii) a lower section of drill string anchored to the borehole wall.

5. The acoustic telemetry system according to claim 1, wherein the force transmitted into the elongated member produces an acoustic wave at the predetermined frequency in the elongated member.

6. The acoustic telemetry system according to claim 5 further having a receiver for detecting the acoustic wave induced into the elongated member.

7. The acoustic telemetry system of claim 1 wherein the elongated member is an upper section of a drill string and the reaction mass is a lower section of the drill string.

8. The acoustic telemetry system of claim 7 wherein the lower section of drill string includes a portion of a bottom hole assembly having a drill bit at an end thereof, the drill bit being in contact with the bottom of the borehole during transmission of signals through the elongated member.

9. The acoustic telemetry system of claim 1 wherein the acoustic actuator includes a magnetostrictive element that applies axial force between the elongated member and the reaction mass upon application of a magnetic field to the magnetostrictive material.

10. The acoustic telemetry system of claim 9 further including a controller downhole for controlling the operation of the acoustic actuator.

11. The acoustic telemetry system of claim 9 further comprising a biasing device for maintaining a predetermined compressive force on the magnetostrictive element.

12. A system for transmitting a signal from a well downhole location to a surface location comprising:

(a) a sensor for detecting at least one parameter of interest downhole;

(b) a controller for converting an output of the sensor to a first signal indicative of the at least one parameter of interest;

(c) at least one elongated member from within the borehole to the surface location, the elongated member being substantially free to move axially toward the surface and capable of carrying acoustic waves therethrough;

(d) at least one actuator in communication with the at least one elongated member for receiving the first signal from the controller and for inducing an acoustic wave representative of the first signal into the signal conducting mass;

(e) a reaction mass in communication with the at least one actuator, the reaction mass being greater than the at least one signal conducting mass such that substantially all of the acoustic wave is transferred to the signal conducting mass and wherein the signal conducting mass is coupled to the reaction mass by the at least one actuator;

(f) an acoustic wave receiver disposed in the at least one signal conducting mass for receiving the acoustic wave and for converting the acoustic wave to a second signal indicative of the at least one parameter of interest; and (g) a processor for processing the second signal from the acoustic wave receiver and for delivering the processed second signal to an output device.

13. The system of claim 12 wherein the at least one actuator includes a magnetostrictive device further comprising a magnetostrictive material and a conductor spirally disposed about the magnetostrictive material.

14. The system of claim 13 wherein the controller further comprises;

(a) a first processor for processing the output;

b) a power supply capable of delivering a sinusoidal current; and c) a converter for converting the processed signal to a sinusoidal current and for delivering the sinusoidal current to the conductor.

15. A method for transmitting signals from within a well borehole to a surface location using an acoustic telemetry system, the method comprising:

(a) disposing an elongated member into the borehole from the surface location, the elongated member being substantially free to move axially toward the surface and capable of carrying acoustic waves therethrough; and (b) applying and axial force at a predetermined frequency with an acoustic actuator between a lower end of the elongated member and a reaction mass in the borehole adjacent the lower end of the elongated member, the mass of the reaction mass being greater than the mass of the elongated member by an amount that causes a substantial portion of the axial force to transmit into the elongated member at the predetermined frequency, the axial force transmitted into the elongated member being indicative of the signal.

16. The method of claim 15 wherein applying the axial force produces an acoustic wave in the elongated member at the predetermined frequency.

17. The method of claim 16 further comprising detecting the acoustic wave with a receiver.

18. A method of transmitting a downhole signal indicative of at least one parameter of interest to the surface of a well system comprising:

a) sensing the at least one parameter of interest with a sensor;

b) converting an output of the sensor to a sinusoidal current;

c) stimulating a magnetostrictive actuator with the sinusoidal current to produce an acoustic wave;

d) inducing the acoustic wave into a pipe with the magnetostrictive actuator;

e) restricting acoustic wave path with a reaction mass;

f) receiving the acoustic wave with an acoustic wave receiver;

g) converting the acoustic wave to a signal;

h) processing the signal with a processor; and i) providing an output from the processor to an output device.

19. The method of claim 18 further comprising biasing the magnetostrictive actuator with a predetermined compression load with a biasing element.

20. The method of claim 18 further comprising repeating (b)–(f) in order to extend a transmission distance.

* * * * *